US011565366B2

(12) United States Patent
Tokushige et al.

(10) Patent No.: US 11,565,366 B2
(45) Date of Patent: Jan. 31, 2023

(54) POLISHING PAD AND METHOD FOR PRODUCING THE SAME, AND METHOD FOR PRODUCING POLISHED PRODUCT

(71) Applicant: FUJIBO HOLDINGS, INC., Tokyo (JP)

(72) Inventors: Shin Tokushige, Saijo (JP); Keisuke Nakase, Tokyo (JP); Hiroshi Kashiwada, Saijo (JP); Tatsuya Yamada, Saijo (JP); Yousuke Narada, Saijo (JP); Kenichi Koike, Saijo (JP)

(73) Assignee: FUJIBO HOLDINGS, INC., Tokyo (JP)

( * ) Notice: Subject to any disclaimer, the term of this patent is extended or adjusted under 35 U.S.C. 154(b) by 1003 days.

(21) Appl. No.: 16/305,279

(22) PCT Filed: May 29, 2017

(86) PCT No.: PCT/JP2017/019916

§ 371 (c)(1),
(2) Date: Nov. 28, 2018

(87) PCT Pub. No.: WO2017/209050

PCT Pub. Date: Dec. 7, 2017

(65) Prior Publication Data

US 2020/0331115 A1 Oct. 22, 2020

(30) Foreign Application Priority Data

Jun. 1, 2016 (JP) ..... 2016-110416
Sep. 28, 2016 (JP) ..... JP2016-189130

(51) Int. Cl.
*B24B 37/24* (2012.01)
*B24D 3/28* (2006.01)
(Continued)

(52) U.S. Cl.
CPC ..... *B24B 37/044* (2013.01); *B24B 37/24* (2013.01); *B24D 3/28* (2013.01); *D04B 1/12* (2013.01);
(Continued)

(58) Field of Classification Search
None
See application file for complete search history.

(56) References Cited

U.S. PATENT DOCUMENTS 6,835,120 B1 12/2004 Matsui
2005/0255794 A1* 11/2005 Vangsness ..... B24B 37/205 451/36

FOREIGN PATENT DOCUMENTS

JP H05-008178 A 1/1993
JP 2001-205555 A 7/2001
(Continued)

OTHER PUBLICATIONS

Machine translation of JP2013182952 (Year: 2013).*
Machine translation of JP2010029996 (Year: 2010).*

*Primary Examiner* — Shawn Mckinnon
(74) *Attorney, Agent, or Firm* — Squire Patton Boggs (US) LLP

(57) ABSTRACT

A polishing pad comprising a knitted fabric constituted by warp knitting or weft knitting, and a resin with which the knitted fabric is impregnated, and having a cross section cut in a surface direction of the knitted fabric, as a polishing surface.

16 Claims, 1 Drawing Sheet

(51) Int. Cl.

| | |
|---|---|
| ***D04B 1/12*** | (2006.01) |
| ***D04B 1/22*** | (2006.01) |
| ***D06M 13/127*** | (2006.01) |
| ***D06M 15/564*** | (2006.01) |
| ***D06M 23/10*** | (2006.01) |
| ***B24B 37/04*** | (2012.01) |

(52) U.S. Cl.
CPC ..... *D04B 1/22* (2013.01); *D06M 13/127* (2013.01); *D06M 15/564* (2013.01); *D06M 23/10* (2013.01); *D06M 2200/35* (2013.01)

(56) References Cited

FOREIGN PATENT DOCUMENTS

| | | | |
|---|---|---|---|
| JP | 2002-283221 | A | 10/2002 |
| JP | 2004-358588 | A | 12/2004 |
| JP | 3652572 | B2 | 5/2005 |
| JP | 2007-061961 | A | 3/2007 |
| JP | 2010-029996 | A | 2/2010 |
| JP | 2010-064216 | A | 3/2010 |
| JP | 2010-201591 | A | 9/2010 |
| JP | 2013-182952 | A | 9/2013 |
| JP | 2013-240839 | A | 12/2013 |
| JP | 2015-037823 | A | 2/2015 |
| JP | 2015-221462 | A | 12/2015 |

* cited by examiner

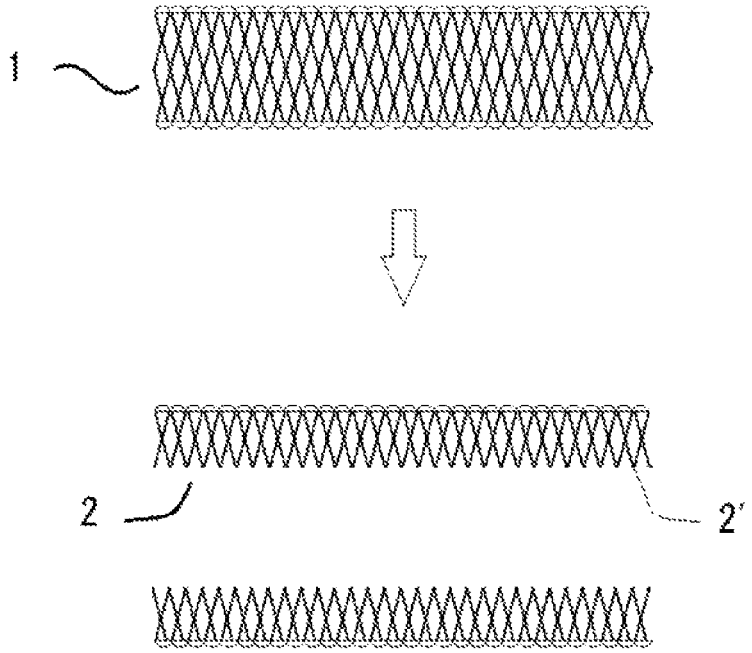
1
2
2'

POLISHING PAD AND METHOD FOR PRODUCING THE SAME, AND METHOD FOR PRODUCING POLISHED PRODUCT

TECHNICAL FIELD

The present invention relates to a polishing pad and a method for producing the same, and a method for producing a polished product.

BACKGROUND ART

In recent years, materials such as silicon carbide (SiC), gallium nitride (GaN), diamond (C), sapphire ($Al_2O_3$) and aluminum nitride (AlN), which are wide band-gap semiconductors, have attracted attention as next-generation power semiconductor element materials. For example, silicon carbide (SiC) has excellent physical property values such as a band gap 3 times and a breakdown electric field strength about 7 times those of silicon (Si) semiconductors, and is excellent in high-temperature operability and also small in size and high in energy-saving effect as compared with current silicon semiconductors. In addition, sapphire wafers are increasingly of importance in electronic equipment having optical elements, such as components for high-performance projectors, due to their chemical stability, optical characteristics (transparency), mechanical strength, thermal characteristics (heat conductivity), and the like. In order to really spread such next-generation power devices, an increase in the substrate diameter and the mass production of substrates are promoted, and the importance of substrate processing techniques is also increased along therewith.

In such a processing process, a cylindrical single crystal (ingot) for use in wafers is sliced and thus cut out into a disc shape, as in silicon (Si). Next, the surface of the disc-shaped single crystal obtained by slicing is flattened by, first, performing primary lapping (rough lapping) and secondary lapping (finishing lapping) by use of a lapping platen for rough removal of the roughness of the surface. Thereafter, primary polishing (rough polishing) and secondary polishing (finishing polishing) are performed for a further enhancement in the flatness of the surface of the disc-shaped single crystal obtained by slicing and for removal of fine scratches on the surface for mirror finishing.

Conventionally, a cloth for semiconductor wafer polishing, in which a felt-like fibrous sheet is impregnated with a thermoplastic polyurethane resin, an expanded polyurethane polishing pad, and the like have been used in processing of a common Si semiconductor wafer or the like (see, for example, Patent Literature 1). In addition, there is known, as lapping processing for a high-hardness material such as SiC much higher in hardness than Si, in particular, lapping processing where a metallic platen of copper, tin, and the like is used and the platen and a diamond abrasive grain are combined (hereinafter, also referred to as "diamond lapping".) (see, for example, Patent Literature 2).

Chemical mechanical polishing (CMP) is generally adopted as a specific polishing method for primary polishing (rough polishing) and secondary polishing (finishing polishing). As polishing pads for use in CMP, there are known, for example, a resin-impregnated non-woven fabric and an expanded polyurethane (see, for example, Patent Literature 3), and a polishing pad formed so that one end of each of a plurality of fabric members fixed by a resin is exposed on a polishing surface where an object to be processed is polished (see, for example, Patent Literature 4).

CITATION LIST

Patent Literatures

Patent Literature 1: Japanese Patent Laid-Open No. H05-8178

Patent Literature 2: Japanese Patent Laid-Open No. 2007-61961

Patent Literature 3: Japanese Patent Laid-Open No. 2001-205555

Patent Literature 4: Japanese Patent Laid-Open No. 2015-221462

SUMMARY OF INVENTION

Technical Problem

A metallic platen, however, is heavy, and thus is difficult to handle, and furthermore has the following problem: it takes an effort to conduct the maintenance after use, for example, the care for a platen surface in which a diamond abrasive grain is embedded. In addition, when a common polishing cloth for use in polishing processing of Si is adopted for processing of SiC or the like, the cloth has the problem of being low in lapping rate and being not suitable for practical use. Furthermore, sapphire, in addition to SiC, has a modified Mohs hardness next to those of diamond and SiC, is high in resistance to chemicals and is extremely difficult to process. Therefore, there is demanded a lapping material excellent in handleability and also excellent in lapping rate in lapping processing of a material expected as a next-generation power semiconductor element material, in particular, a high-hardness difficult-to-process material, besides a common Si semiconductor wafer and the like.

The resin-impregnated non-woven fabric and the expanded polyurethane disclosed in Patent Literature 3 have the problem of being low in polishing rate in polishing processing of a material expected as a next-generation power semiconductor element material, in particular, a high-hardness difficult-to-process material. Furthermore, the resin-impregnated non-woven fabric suffers from the disadvantage of being inferior in surface quality because the base material thereof is a non-woven fabric made of a short fiber and thus fiber tangling is less generated to cause a fiber released in polishing to generate scratches in a workpiece (polishing workpiece).

The polishing pad for chemical mechanical polishing, disclosed in Patent Literature 4, then has the problem of being inferior in surface quality because no fiber tangling is made to further easily cause fiber releasing to occur as compared with a non-woven fabric, causing an ununiform polishing surface, and also causing a fiber released to generate scratches in a workpiece.

The present invention has been made in view of the above circumstances, and an object thereof is to provide a polishing pad excellent in polishing rate and also excellent in surface quality of the resulting polishing workpiece, and a method for producing the polishing pad, as well as a method for producing a polished product by use of the polishing pad. Herein, the polishing pad of the present invention can be used for primary lapping (rough lapping), secondary lapping (finishing lapping), primary polishing (rough polishing), secondary polishing (finishing polishing), and any processing (hereinafter, also simply collectively referred to as "polishing".) doubling as such a plurality of such lappings and polishings. In addition, when the "polishing rate" is described without any limitation on the differentiation among primary lapping, secondary lapping, primary polishing, and secondary polishing, the "polishing rate" also encompasses the "lapping rate".

Solution to Problem

The present inventors have made intensive studies in order to solve the above problems. As a result, the inventors have found that the above problems can be solved by a polishing pad including a base material where a knitted fabric is sliced (cut) in a surface direction, thereby leading to completion of the present invention.

That is, the present invention is as follows.

[1]

A polishing pad comprising: a knitted fabric constituted by warp knitting or weft knitting; and a resin with which the knitted fabric is impregnated, wherein the polishing pad has a cross section cut in a surface direction of the knitted fabric, as a polishing surface.

[2]

The polishing pad according to [1], wherein a fiber constituting the knitted fabric is at least partially a false twisted yarn.

[3]

The polishing pad according to [1] or [2], wherein the resin comprises a first resin and a second resin different from the first resin, and the second resin is a reaction product of a urethane prepolymer having an NCO equivalent of 450 or less and a curing agent.

[4]

The polishing pad according to any one of [1] to [3], wherein the resin comprises a first resin and a second resin different from the first resin, and a content of the knitted fabric is 30 to 60% by mass based on a total amount of the knitted fabric, the first resin and the second resin.

[5]

The polishing pad according to any one of [1] to [4], wherein a number average diameter of a single yarn constituting the knitted fabric is 3 to 30 μm.

[6]

The polishing pad according to any one of [1] to [5], wherein a fineness of the single yarn constituting the knitted fabric is 0.1 to 10 dtex.

[7]

The polishing pad according to any one of [1] to [6], having a compressive modulus of 0.5 to 20%.

[8]

The polishing pad according to any one of [1] to [7], having a compressive elastic modulus of 50 to 98%.

[9]

The polishing pad according to any one of [1] to [8], having an A hardness of 50 to 98°.

[10]

The polishing pad according to any one of [1] to [9], having a thickness of 0.5 to 5.0 mm.

[11]

The polishing pad according to any one of [1] to [10], wherein the knitted fabric comprises a paralleled knitting yarn constituted with two or more fibers having a different melting point from each other being paralleled.

[12]

The polishing pad according to [11], wherein a knitting yarn constituting front and rear surfaces of the knitted fabric comprises the paralleled knitting yarn.

[13]

The polishing pad according to [11] or [12], wherein a melting point of a fiber having the lowest melting point among the two or more fibers having a different melting point from each other is 50 to 180° C.

[14]

The polishing pad according to any one of [11] to [13], wherein a melting point of a fiber having the highest melting point among the two or more fibers having a different melting point from each other is 200 to 400° C.

[15]

A method for producing a polishing pad, comprising:

a primary impregnation step of impregnating a knitted fabric constituted by warp knitting or weft knitting with a resin solution comprising a first resin, and performing wet coagulation to thereby provide a resin-impregnated knitted fabric, an immersion step of immersing the resin-impregnated knitted fabric in an immersion liquid comprising a solvent in which the first resin is soluble.

a cutting step of cutting the resin-impregnated knitted fabric after the immersion step, in a surface direction of the knitted fabric, and a secondary impregnation step of impregnating the resin-impregnated knitted fabric after the cutting step with a solution comprising a urethane prepolymer having an NCO equivalent of 450 or less and a curing agent.

[16]

The method for producing a polishing pad according to [15], wherein the knitted fabric is a knitted fabric knitted by warp knitting or weft knitting, comprising a paralleled knitting yarn constituted with two or more fibers having a different melting point from each other being paralleled, and the method further comprises a heat-setting step of performing heating at a temperature equal to or more than a softening point and less than a melting point of a fiber having the lowest melting point among the two or more fibers having a different melting point from each other, before the primary impregnation step.

[17]

The method for producing a polishing pad according to [15] or [16], wherein the first resin is soluble in one or more selected from the group consisting of N,N-dimethylformaldehyde, dimethylacetamide, methyl ethyl ketone and dimethylsulfoxide.

[18]

The method for producing a polishing pad according to any one of [15] to [17], wherein the solvent comprises one or more solvents selected from the group consisting of N,N-dimethylformaldehyde, dimethylacetamide, methyl ethyl ketone and dimethylsulfoxide.

[19]

A method for producing a polished product, comprising:

a polishing step of polishing a polishing workpiece by use of the polishing pad according to any one of [1] to [14].

Advantageous Effect of Invention

The present invention can provide a polishing pad excellent in polishing rate and also excellent in surface quality of the resulting polishing workpiece, and a method for producing the polishing pad, as well as a method for producing a polished product by use of the polishing pad.

BRIEF DESCRIPTION OF DRAWING

FIG. 1 shows schematic views illustrating a cutting step in a method for producing a polishing pad of the present embodiment.

DESCRIPTION OF EMBODIMENTS

Hereinafter, an embodiment (hereinafter, simply referred to as "the present embodiment".) for carrying out the present invention will be described in detail, if necessary, with reference to the drawings. In addition, the positional relationship among up and down, left and right, and the like is based on the positional relationship illustrated in the drawings, unless particularly noted. Furthermore, the dimensional ratio in the drawings is not limited to the ratio illustrated. In the present embodiment, the "fiber" refers to a filament (multifilament) with a plurality of single yarns (monofilaments) collected. In addition, the "knitting yarn" refers to a fiber to be fed to a yarn feeder in production of a knitted fabric, and examples include a paralleled knitting yarn constituted with two or more fibers having a different melting point from each other being paralleled, and a knitting yarn made of one fiber, other than such a paralleled knitting yarn.

[Polishing Pad]

The polishing pad of the present embodiment includes a knitted fabric constituted by warp knitting or weft knitting, and a resin with which the knitted fabric is impregnated, and has a cross section in the surface direction of the knitted fabric, as a polishing surface. The polishing pad of the present embodiment includes a knitted fabric constituted by warp knitting or weft knitting with the knitted fabric being cut in the surface direction, and thus has a uniform fiber end distribution and is suppressed in release of a fiber on the polishing surface. Therefore, the polishing pad is more excellent in polishing rate and can be ensured in polishing surface quality. In addition, a regular fiber end distribution can allow an abrasive grain to effectively act and can contribute to an enhancement in polishing rate. Furthermore, a regular fiber end distribution enables more even polishing to be achieved, and can contribute to achievement of polishing imparting excellent surface quality. Herein, the cross section of the knitted fabric in the surface direction may be a polishing surface entirely covered with a resin, may be a polishing surface at least partially covered with a resin, which is constituted from a cross section not covered with a resin and a resin surface with which the cross section is covered, or may be a polishing surface entirely not covered with a resin.

In addition, the polishing pad of the present embodiment includes a knitted fabric and a resin, and thus is light in weight and excellent in handleability and maintainability as compared with a metallic platen. In addition, the polishing pad includes a knitted fabric constituted by warp knitting or weft knitting, and thus is more excellent in polishing rate than a polishing pad where a non-woven fabric is impregnated with a resin. The reason for this is considered because a knitted fabric constituted by warp knitting or weft knitting, having a regular knitting structure, is used to thereby make the internal structure of the polishing pad more uniform and also the surface (polishing surface) of the polishing pad has a regular protrusion and depression pattern, but the reason is not limited thereto.

The polishing pad of the present embodiment can be suitably used for chemical mechanical polishing (CMP) such as primary lapping (rough lapping), secondary lapping (finishing lapping), primary polishing (rough polishing), or secondary polishing (finishing polishing), without any particular limitation. In particular, the change in knitting system of the knitted fabric enables a polishing pad depending on the required polishing rate and surface quality to be easily constituted.

The compressive modulus of the polishing pad is preferably 0.5 to 20%, more preferably 1 to 10%, further preferably 1 to 7%. When the compressive modulus is 0.5% or more, surface quality of a polishing workpiece tends to be more enhanced to more enhance close contactability of the polishing pad and the polishing workpiece. In addition, when the compressive modulus is 20% or less, the polishing rate tends to be able to be more enhanced to more suppress deformation of the polishing pad. Herein, the compressive modulus can be measured by a method described in Examples. The compressive modulus tends to be increased by, for example, adjusting the density of the resulting polishing pad to a low value in a preferable production method described below.

The compressive elastic modulus of the polishing pad is preferably 50 to 98%, more preferably 50 to 95%, further preferably 50 to 90%. When the compressive elastic modulus is 50% or more, the polishing rate tends to be able to be more enhanced to more suppress deformation of the polishing pad. In addition, when the compressive elastic modulus is 98% or less, close contactability with a polishing workpiece tends to be more enhanced. Herein, the compressive elastic modulus can be measured by a method described in Examples. The compressive elastic modulus tends to be increased by, for example, increasing the content of a second resin in a preferable production method described below.

The A hardness of the polishing pad is preferably 50 to 98°, more preferably 60 to 95°, further preferably 70 to 95°. When the A hardness is 50° or more, deformation of the polishing pad tends to be able to be more suppressed. In addition, when the A hardness is 98° or less, close contactability with a polishing workpiece tends to be more enhanced. Herein, the A hardness can be measured by a method described in Examples. The A hardness tends to be increased by, for example, increasing the content of a second resin in a preferable production method described below.

The density of the polishing pad is preferably 0.35 to 0.70, more preferably 0.35 to 0.60, further preferably 0.35 to 0.60. When the density is 0.35 or more, a reduction in pressure at the point of action due to the permanent strain of the polishing pad and an increase in the contact area with a polishing workpiece tends to be able to be more suppressed. In addition, when the density is 0.70 or less, slurry retention ability tends to be more enhanced. Herein, the density can be measured by a method described in Examples. The density tends to be increased by, for example, increasing the contents of a first resin and a second resin in the knitted fabric in a preferable production method described below.

The thickness of the polishing pad is preferably 0.5 to 5.0 mm, more preferably 1.0 to 2.0 mm, further preferably 1.0 to 1.5 mm. When the thickness is 0.5 mm or more, conformability to a polishing workpiece tends to be more enhanced. In addition, when the thickness is 5.0 mm or less, deformation (waviness or surface shape) of a polishing workpiece tends to be more improved. Herein, the thickness can be measured by a method described in Examples. The thickness can be adjusted by, for example, selecting a knitting system of the knitted fabric.

[Knitted Fabric]

The knitted fabric is constituted by warp knitting or weft knitting. The knitted fabric constituted by warp knitting or weft knitting has a regular knitting structure as compared with a non-woven fabric, and thus the fiber end distribution in the polishing surface and the internal structure of the polishing pad are more uniform. Therefore, the distribution state of the resin for impregnation is also easily uniform, and an enhancement in the polishing rate can be achieved. In addition, a regular fiber end distribution enables an abrasive grain to effectively act, and can contribute to an enhancement in the polishing rate. Furthermore, a regular fiber end distribution enables more even polishing to be achieved, and can contribute to achievement of polishing excellent in surface quality.

The polishing pad of the present embodiment can be used for any of polishing processing and lapping processing, and is preferably used for a primary polishing application and/or secondary polishing application. In particular, the change in knitting system of the knitted fabric enables a polishing pad depending on the required polishing rate and surface quality to be easily constituted.

The warp knitting is not here particularly limited, and examples include tricot such as single tricot and double tricot; raschel such as single raschel and double raschel; and milanese. The warp knitting is preferably raschel from the viewpoint that the effect of the present invention is more effectively exerted.

The weft knitting is not particularly limited, and examples include circular knitting such as single knitting and double knitting; and flat knitting such as rib knitting, interlock stitch and flat pearl knitting. The single knitting is not particularly limited, and examples include sinker top circular knitting, French circular knitting and Tompkins knitting. The double knitting is not particularly limited, and examples include rib circular knitting, circular interlock knitting and cardboard knitting. The weft knitting is preferably circular knitting, more preferably cardboard knitting from the viewpoint that the effect of the present invention is more effectively exerted.

The fiber constituting the knitted fabric is not particularly limited, and examples include a fiber of polyester such as polyethylene terephthalate, polybutylene terephthalate and polylactate; a fiber of polyamide such as nylon 6, nylon 66, nylon 11, nylon 12 and nylon 610; and a fiber of polyolefin such as polyethylene and polypropylene. Among them, a fiber of polyester is preferable.

The fiber constituting the knitted fabric is preferably at least partially a false twisted yarn. When the false twisted yarn is used, the internal structure of the knitted fabric, while having a regular knitting structure, has a structure where an interfiber space is small as compared with the case of no false twisted yarn used. Thus, an interfiber space is decreased and the fiber twisted is easily impregnated with the resin. Therefore, the fiber and the resin constituting the knitted fabric are more uniformly distributed in the fiber end distribution of the cross section obtained by cutting (slicing) of the knitted fabric in the surface direction, and the internal structure of the polishing pad. As a result, the distribution of protrusions and depressions of the polishing surface and the internal structure of the polishing pad, where the fiber end distribution of the cross section is directly or indirectly reflected, are more uniform, and the polishing rate tends to be more enhanced. In addition, when the false twisted yarn is used, impregnation ability of the knitted fabric with the resin also tends to be more enhanced.

The types of fibers mainly constituting the front and rear surfaces of the knitted fabric and a fiber mainly constituting the intermediate structure (structure located between the front and rear surfaces) of the knitted fabric may be the same or different from each other. The types of the fiber mainly constituting the front and rear surfaces of the knitted fabric and the fiber mainly constituting the intermediate structure of the knitted fabric can be appropriately adjusted depending on the knitting system and fiber selection. For example, when the false twisted yarn is used as the fiber mainly constituting the intermediate structure of the knitted fabric, the fiber end distribution of the polishing surface and the internal structure of the polishing pad are more uniform, and the polishing rate tends to be more enhanced, as described above.

The number average diameter of the single yarn constituting the knitted fabric is preferably 3 to 30 μm, more preferably 5 to 25 μm, further preferably 10 to 20 μm. When the number average diameter of the single yarn constituting the knitted fabric is within the range, the production of the yarn and knitted fabric tends to be more facilitated.

The fineness of the single yarn constituting the knitted fabric is preferably 0.1 to 10 dtex, more preferably 0.3 to 6 dtex, further preferably 0.9 to 4 dtex. When the fineness of the single yarn constituting the knitted fabric is within the range, the production of the yarn and knitted fabric tends to be more facilitated.

The fineness of the fiber constituting the knitted fabric is preferably 30 to 300 dtex, more preferably 40 to 250 dtex, further preferably 50 to 200 dtex. When the fineness of the fiber constituting the knitted fabric is within the range, the production of the yarn and knitted fabric tends to be more facilitated. Herein, the "fiber" refers to a multifilament with a plurality of single yarns (monofilaments) collected.

The number of filaments per fiber constituting the knitted fabric is preferably 10 to 100, preferably 15 to 75, preferably 20 to 50. When the number of filaments per fiber is within the range, the production of the yarn and knitted fabric tends to be more facilitated.

In the polishing pad of the present embodiment, the knitted fabric may include a paralleled knitting yarn constituted with two or more fibers having a different melting point from each other being paralleled (hereinafter, also simply referred to as "paralleled knitting yarn"). A common knitted fabric has the property of being easily stretched and deformed by application of tension in the surface direction. Therefore, a polishing pad using such a knitted fabric has the problem of being easily deformed due to contraction/expansion by tension applied in the production step or during curing of a resin for impregnation. Such deformation can deteriorate uniformity of the internal structure of the resulting polishing pad and regularity of the protrusion and depression pattern of the polishing surface, also consequently affecting the polishing rate and the surface quality of the resulting polishing workpiece. On the contrary, the polishing pad of the present embodiment can include a paralleled knitting yarn constituted with two or more fibers having a different melting point from each other being paralleled, thereby allowing for heat-setting (heat fixation) of fibers having a low melting point, and allowing for introduction of a large number of fusing points where fibers having a low melting point are fused at the intersection thereof, into the knitted fabric. Such a fusing point can be introduced to thereby suppress deformation of the knitted fabric, resulting in further enhancements in the polishing rate and the surface quality of the resulting polishing workpiece.

A fiber having the lowest melting point (hereinafter, also referred to as "low melting fiber".) among the fibers included in the paralleled knitting yarn is easily affected by an external factor such as heat, but can be relatively easily softened by heating, and mutually fused. On the other hand, a fiber having the highest melting point (hereinafter, also referred to as "high melting fiber".) is hardly affected by an external factor such as heat, and can enhance the hardness and the like of the polishing pad. Thus, a fiber having a low melting point can be subjected to mutual heat fixation to thereby suppress deformation of the knitted fabric, and enables the problem of a knitted fabric: stretching and deformation are easily caused by application of tension in the surface direction; to be solved. Herein, when the paralleled knitting yarn includes three or more fibers having a different melting point from one another, a fiber having the lowest melting point is defined as the low melting fiber, and a fiber having the highest melting point is defined as the high melting fiber.

As the knitting yarn constituting the knitted fabric, only the paralleled knitting yarn may be used, or the paralleled knitting yarn and a knitting yarn other than the paralleled knitting yarn (hereinafter, also referred to as "non-paralleled knitting yarn".) may be used in combination.

The fiber constituting the knitting yarn is not particularly limited, and examples include a fiber of polyester such as polyethylene terephthalate (melting point: 255 to 260° C.), polybutylene terephthalate (melting point: 232 to 267° C.) and polylactate (melting point: 170° C.); a fiber of polyamide such as low melting nylon (melting point: 110 to 120° C.), nylon 6 (melting point: 225° C.), nylon 66 (melting point: 265° C.), nylon 11 (melting point: 187° C.), nylon 12 (melting point: 176° C.), nylon 610 (melting point: 225° C.) and nylon 612 (melting point: 220° C.); a fiber of polyolefin such as low-density polyethylene (melting point: 95 to 130° C.), high-density polyethylene (melting point: 120 to 140° C.), an ethylene-vinyl acetate copolymer (melting point: 65 to 90° C.) and polypropylene (melting point: 165° C.); and an acrylic fiber (melting point: 317° C.). Herein, the melting points in the brackets are reference values, the melting point of a resin constituting each fiber is not limited to the above, and a commercially available product can be appropriately used.

The melting point of the low melting fiber, among the two or more fibers having a different melting point from each other constituting the paralleled knitting yarn, is preferably 50 to 180° C., more preferably 75 to 170° C., further preferably 100 to 150° C. When the melting point of the low melting fiber is 180° C. or less, deformation of the knitted fabric can be suppressed, and as a result, the polishing rate and the surface quality of the resulting polishing workpiece tend to be more enhanced. When the melting point of the low melting fiber is 50° C. or more, physical properties such as the hardness of the polishing pad tends to be more enhanced. Such a fiber is not particularly limited, and examples include fibers of polylactate (melting point: 170° C.), low melting polyethylene terephthalate (melting point: 130 to 180° C.), low melting nylon (melting point: 100 to 130° C.), nylon 12 (melting point: 176° C.), low-density polyethylene (melting point: 95 to 130° C.), high-density polyethylene (melting point: 120 to 140° C.), ethylene-vinyl acetate copolymer (melting point: 65 to 90° C.), and polypropylene (melting point: 165° C.).

The melting point of the high melting fiber, among the two or more fibers having a different melting point from each other constituting the paralleled knitting yarn, is preferably 200 to 400° C., more preferably 210 to 380° C., further preferably 220 to 360° C. When the melting point of the high melting fiber is within the range, physical properties such as the hardness of the polishing pad tends to be more enhanced. Such a fiber is not particularly limited, and examples include fibers of polyethylene terephthalate (melting point: 255 to 260° C.), polybutylene terephthalate (melting point: 232 to 267° C.), nylon 610 (melting point: 225° C.), and nylon 612 (melting point: 220° C.), and an acrylic fiber (melting point: 317° C.).

The fineness of the high melting fiber constituting the paralleled knitting yarn is preferably 30 to 300 dtex, more preferably 40 to 250 dtex, further preferably 50 to 200 dtex. When the fineness of the high melting fiber constituting the paralleled knitting yarn is within the range, production of the yarn and the knitted fabric tends to be more enhanced.

The fineness of the low melting fiber constituting the paralleled knitting yarn is preferably 3 to 30 dtex, more preferably 4 to 25 dtex, further preferably 5 to 20 dtex. When the fineness of the low melting fiber constituting the paralleled knitting yarn is within the range, production of the yarn and the knitted fabric tends to be more enhanced.

The fineness of the low melting fiber in the paralleled knitting yarn is preferably 5 to 20%, more preferably 5 to 17.5%, further preferably 7.5 to 15% relative to the fineness of the high melting fiber. When the fineness of the low melting fiber is 5% or more relative to the fineness of the high melting fiber, fusion of the low melting fiber tends to be stronger, and deformation of the knitted fabric tends to be more suppressed. When the fineness of the low melting fiber is 20% or less relative to the fineness of the high melting fiber, physical properties of the polishing pad, the amount of the resin for impregnation, the porosity, and the like, are enhanced in a balanced manner, and the polishing rate tends to be more enhanced.

The fineness of the fiber constituting the non-paralleled knitting yarn is preferably 30 to 300 dtex, more preferably 40 to 250 dtex, further preferably 50 to 200 dtex. When the fineness of the fiber constituting the non-paralleled knitting yarn is within the range, production of the yarn and the knitted fabric tends to be more enhanced.

The number of filaments per high melting fiber constituting the paralleled knitting yarn is preferably 10 to 100, preferably 15 to 75, preferably 20 to 50. When the number of filaments per high melting fiber constituting the paralleled knitting yarn is within the range, production of the yarn and the knitted fabric tends to be more enhanced.

The number of filaments per low melting fiber constituting the paralleled knitting yarn is preferably 1 to 10, preferably 2 to 7, preferably 2 to 5. When the number of filaments per low melting fiber constituting the paralleled knitting yarn is within the range, production of the yarn and the knitted fabric tends to be more enhanced.

The number of filaments per fiber constituting the non-paralleled knitting yarn is preferably 10 to 100, preferably 15 to 75, preferably 20 to 50. When the number of filaments per fiber constituting the non-paralleled knitting yarn is within the range, production of the yarn and the knitted fabric tends to be more enhanced.

Examples of the knitted fabric using the paralleled knitting yarn include a knitted fabric where the knitting yarn mainly constituting the front and rear surfaces of the knitted fabric is a paralleled knitting yarn and the knitting yarn mainly constituting the intermediate structure (structure located between the front and rear surfaces) of the knitted fabric is a non-paralleled knitting yarn; a knitted fabric where both of the knitting yarn mainly constituting the front and rear surfaces of the knitted fabric and the knitting yarn mainly constituting the intermediate structure (structure located between the front and rear surfaces) of the knitted fabric are paralleled knitting yarns; and a knitted fabric where the knitting yarn mainly constituting the front and rear surfaces of the knitted fabric is a non-paralleled knitting yarn and the knitting yarn mainly constituting the intermediate structure (structure located between the front and rear surfaces) of the knitted fabric is a paralleled knitting yarn. In particular, a knitted fabric where the knitting yarn mainly constituting the front and rear surfaces of the knitted fabric includes a paralleled knitting yarn is preferable, and a knitted fabric where the knitting yarn mainly constituting the front and rear surfaces of the knitted fabric is a paralleled knitting yarn and the knitting yarn mainly constituting the intermediate structure (structure located between the front and rear surfaces) of the knitted fabric is a non-paralleled knitting yarn is more preferable. When such a knitted fabric is used, deformation tends to be suppressed to more enhance uniformity of a knitted fabric structure without any characteristics of the knitted fabric being impaired.

The types of the fiber mainly constituting the front and rear surfaces of the knitted fabric and the fiber mainly constituting the intermediate structure (structure located between the front and rear surfaces) of the knitted fabric may be different from each other. The types of the fiber mainly constituting the front and rear surfaces of the knitted fabric and the fiber mainly constituting the intermediate structure of the knitted fabric can be appropriately adjusted depending on the knitting system and fiber selection. Furthermore, when the false twisted yarn is used as the fiber mainly constituting the intermediate structure of the knitted fabric, the fiber end distribution of the polishing surface and the internal structure of the polishing pad are more uniform, and the polishing rate tends to be more enhanced, as described above.

[Resin]

The resin with which the knitted fabric is impregnated is not particularly limited, and examples include polyurethane-based resins such as polyurethane and polyurethane polyurea; acrylic resins such as polyacrylate and polyacrylonitrile; vinyl resins such as polyvinyl chloride, polyvinyl acetate and polyvinylidene fluoride; polysulfone-based resins such as polysulfone and polyethersulfone; acylated cellulose-based resins such as acetylated cellulose and butyrylated cellulose; polyamide-based resins; and polystyrene-based resins.

Among them, the resin with which the knitted fabric is impregnated preferably includes a polyurethane-based resin. Examples of the polyurethane-based resin include, but not limited to the following, a polyester-based polyurethane resin, a polyether-based polyurethane resin and a polycarbonate-based polyurethane resin. When such a resin is used, the polishing rate tends to be more enhanced.

Such a resin with which the knitted fabric is impregnated may be used singly or in combinations of two or more thereof. In particular, in a preferable mode of the present embodiment, the resin preferably includes a first resin and a second resin different from the first resin.

The first resin is not particularly limited as long as it is a so-called wet-coagulatable resin with which the knitted fabric can be impregnated, and any of various known resins can be applied. Examples of such a resin include, but not limited to the following, a polyurethane-based resin, an acrylic resin, a vinyl resin, a polysulfone-based resin, an acylated cellulose-based resin, a polyamide-based resin and a polystyrene-based resin. Examples of the polyurethane-based resin include, but not limited to the following, a polyester-based polyurethane resin, a polyether-based polyurethane resin and a polycarbonate-based polyurethane resin. Herein, the "wet coagulation" means that impregnation of the knitted fabric with a resin solution in which the resin is dissolved and immersion of the resultant in a tank including a coagulation liquid (poor solvent to the resin.) thus result in coagulation and regeneration of the resin in the resin solution for impregnation. The solvent in the resin solution and the coagulation liquid are replaced with each other, thereby aggregating and coagulating the resin in the resin solution. Herein, the first resin is preferably soluble in one or more selected from the group consisting of N,N-dimethylformaldehyde, dimethylacetamide, methyl ethyl ketone and dimethylsulfoxide from the viewpoint of being used for wet coagulation.

The 100% modulus at 23±2° C. of the first resin is preferably 5 MPa to 30 MPa, more preferably 5 MPa to 20 MPa. The 100% modulus is a value obtained by dividing a load applied in elongation of a sheet made of the resin at 100%, namely elongation twice the original length, by the unit area.

The second resin is a so-called dry-coagulatable resin with which the knitted fabric can be impregnated, and is not particularly limited as long as it is a reaction product of a urethane prepolymer having an NCO equivalent of 450 or less and a curing agent, and any of various known resins can be applied. Herein, the "dry coagulation" means that impregnation of the knitted fabric with a liquid including a prepolymer and a curing agent and a reaction of the prepolymer and the curing agent thus result in formation of the resin. Herein, the liquid may also include a solvent.

The urethane prepolymer is not particularly limited, and examples include an adduct of hexamethylene diisocyanate and hexanetriol; an adduct of 2,4-tolylene diisocyanate and brenzcatechol; an adduct of tolylene diisocyanate and hexanetriol; an adduct of tolylene diisocyanate and trimethylolpropane; an adduct of xylylene diisocyanate and trimethylolpropane; an adduct of hexamethylene diisocyanate and trimethylolpropane; and an adduct of isocyanuric acid and hexamethylene diisocyanate. The urethane prepolymer may be used singly or in combinations of two or more thereof.

The NCO equivalent of the urethane prepolymer is preferably 450 or less, more preferably 220 to 400, further preferably 250 to 320. When the NCO equivalent of the urethane prepolymer is within the range, the polishing rate tends to be more enhanced. Herein, the "NCO equivalent" means the average NCO equivalent of the urethane prepolymer in the resin solution. The NCO equivalent can be measured by a well-known method, and can be measured according to JIS K 7301 (1995), for example.

The curing agent is not particularly limited, and examples include amine compounds such as 3,3'-dichloro-4,4'-diaminodiphenylmethane, 4-methyl-2,6-bis(methylthio)-1,3-benzenediamine, 2-methyl-4,6-bis(methylthio)-1,3-benzenediamine, 2,2-bis(3-amino-4-hydroxyphenyl)propane, 2,2-bis[3-(isopropylamino)-4-hydroxyphenyl]propane, 2,2-bis[3-(1-methylpropylamino)-4-hydroxyphenyl]propane, 2,2-bis[3-(1-methylpentylamino)-4-hydroxyphenyl]propane, 2,2-bis(3,5-diamino-4-hydroxyphenyl)propane, 2,6-diamino-4-methylphenol, trimethylethylene bis-4-aminobenzoate and polytetramethyleneoxide-di-p-aminobenzoate; and polyhydric alcohol compounds such as ethylene glycol, propylene glycol, diethylene glycol, trimethylene glycol, tetraethylene glycol, triethylene glycol, dipropylene glycol, 1,4-butanediol, 1,3-butanediol, 2,3-butanediol, 1,2-butanediol, 3-methyl-1,2-butanediol, 1,2-pentanediol, 1,4-pentanediol, 2,4-pentanediol, 2,3-dimethyltrimethylene glycol, tetramethylene glycol, 3-methyl-4,3-pentanediol, 3-methyl-4,5-pentanediol, 2,2,4-trimethyl-1,3-pentanediol, 1,6-hexanediol, 1,5-hexanediol, 1,4-hexanediol, 2,5-hexanediol, 1,4-cyclohexanedimethanol, neopentyl glycol, glycerin, trimethylolpropane, trimethylolethane and trimethylolmethane. The curing agent may be used singly or in combinations of two or more thereof.

The solvent is not particularly limited, and examples include N,N-dimethylformamide, N,N-dimethylacetamide and methyl ethyl ketone.

When the resin includes the first resin and the second resin different from the first resin, the content of the knitted fabric is preferably 30 to 60% by mass, more preferably 30 to 55 by mass based on the total amount of the knitted fabric, the first resin and the second resin. When content of the knitted fabric is within the range, the polishing rate tends to be more enhanced.

Herein, the respective contents of the knitted fabric, the first resin and the second resin can be determined from the mass of a component eluted or the mass of the residue by use of the difference in solubility (polarity) in a polar solvent and the difference in amine degradability. Alternatively, the contents can also be calculated by measuring the density of the polishing pad after a primary impregnation step described below, the density of the polishing pad after an immersion step described below and the density of the polishing pad after a secondary impregnation step described below, respectively, and determining the density difference. Herein, the respective densities can be measured in the same manner as described above.

[Other Components]

The polishing pad may also include, in addition to the knitted fabric and the resin, various additives included in a usual polishing pad, for any purpose. Examples of such additives include, but not limited to the following, a pigment or filler such as carbon black, a hydrophilic additive and a hydrophobic additive.

The hydrophilic additive is not particularly limited, and examples include anionic surfactants such as sodium lauryl sulfate, carboxylate, sulfonate, a sulfate salt and a phosphate salt; and nonionic surfactants such as hydrophilic ester compound, ether compound, ester/ether compound and amide compound.

The hydrophobic additive is not particularly limited, and examples include nonionic surfactants to which an alkyl chain having 3 or more carbon atoms is added, such as polyoxyethylene alkyl ether, polyoxypropylene alkyl ether, polyoxyethylene polyoxypropylene alkyl ether, a perfluoroalkyl ethylene oxide adduct, glycerin fatty acid ester and propylene glycol fatty acid ester.

Furthermore, the polishing pad may also include various remaining materials such as a solvent used in the production process thereof.

[Method for Producing Polishing Pad]

A method for producing a polishing pad of the present embodiment is not particularly limited as long as it is a method including a step of impregnating a knitted fabric with a resin and solidifying the resultant, and a step of performing cutting in the surface direction of the knitted fabric. For example, when a plurality of resins are used, the plurality of resins may be mixed and used for impregnating a knitted fabric at one time, or a multiple-stage impregnation step of impregnating a knitted fabric with a part of the resins and solidifying the resultant, and thereafter impregnating the knitted fabric with the remaining resin and solidifying the resultant may be included. In addition, the timing of cutting is also not particularly limited, a knitted fabric cut in the surface direction thereof in advance may be used, a knitted fabric impregnated with all the resins may be cut, or a knitted fabric impregnated with a part of the resins may be cut and the knitted fabric may be further impregnated with the remaining resin.

The method including the multiple-stage impregnation step by use of the first resin and the second resin is not particularly limited, and examples include a method including a primary impregnation step of impregnating a knitted fabric constituted by warp knitting or weft knitting with a resin solution including the first resin, and performing wet coagulation to thereby provide a resin-impregnated knitted fabric, an immersion step of immersing the resin-impregnated knitted fabric in an immersion liquid including a solvent in which the first resin is soluble, a cutting step of cutting the resin-impregnated knitted fabric after the immersion step, in the surface direction of the knitted fabric, and a secondary impregnation step of impregnating the resin-impregnated knitted fabric after the cutting step with a solution including a urethane prepolymer having an NCO equivalent of 450 or less and a curing agent.

[Heat-Setting Step]

When a knitted fabric knitted by warp knitting or weft knitting, including a paralleled knitting yarn constituted with two or more fibers having a different melting point from each other being paralleled, is used, the method for producing a polishing pad of the present embodiment may further include a heat-setting step of performing heating at a temperature equal to or more than the softening point and less than the melting point of a fiber having the lowest melting point among the two or more fibers having a different melting point from each other, before the primary impregnation step. When the knitted fabric knitted by warp knitting or weft knitting, including a paralleled knitting yarn constituted with two or more fibers having a different melting point from each other being paralleled, is heated at a temperature equal to or more than the softening point and less than the melting point of a low melting fiber, a fusing point is present where a low melting fiber softened is fused at the intersection thereof. Thus, the knitted fabric can be inhibited from being stretched and deformed in the surface direction.

[Primary Impregnation Step]

The primary impregnation step is a step of impregnating a knitted fabric with a resin solution including the first resin and performing wet coagulation to thereby provide a resin-impregnated knitted fabric. When a wet coagulation method is used with the knitted fabric being impregnated with the resin solution, replacement of a solvent in the resin solution with a coagulation liquid on the surface of the resin solution attached to a fiber of the knitted fabric is advanced in a coagulation liquid, thereby coagulating and regenerating the resin on the surface of the fiber.

A specific example of the primary impregnation step is as follows. First, the above first resin, a solvent in which the first resin is soluble and which is miscible with a coagulation liquid described below, and, if necessary, other additive are mixed, and, if necessary, further subjected to defoaming under reduced pressure, thereby preparing a resin solution. The solvent is not particularly limited, and examples include N,N-dimethylformamide (DMF), N,N-dimethylacetamide (DMAC), methyl ethyl ketone (MEK) and dimethylsulfoxide (DMSO). The first resin is preferably soluble in one or more solvents selected from the group consisting of N,N-dimethylformaldehyde, dimethylacetamide, methyl ethyl ketone and dimethylsulfoxide from the viewpoint of selection of a good solvent to the resin and furthermore from the viewpoint of uniform admixture in a coagulation bath for more facilitation of wet coagulation. Similarly, the solvent preferably includes one or more solvents selected from the group consisting of N,N-dimethylformaldehyde, dimethylacetamide, methyl ethyl ketone and dimethylsulfoxide.

The viscosity of the resin solution, measured with a B-type rotational viscometer at 20° C., is preferably 8000 cp or less, more preferably 100 cp to 5000 cp, further preferably 400 cp to 3000 cp from the viewpoint that the entire knitted fabric is impregnated with the resin and from the viewpoint that the amount of the resin for impregnation is sufficiently ensured. In order to obtain a resin solution having a viscosity in such a numerical range, for example, a polyurethane resin may be dissolved in the solvent in the range from 5 to 25% by mass, more preferably in the range from 8 to 20% by mass based on the total amount of the resin solution. The viscosity of the resin solution also depends on the type and the molecular weight of the resin to be used, and it is thus preferable to comprehensively consider them to thereby perform selection of the resin, setting of the concentration, and the like.

Next, the knitted fabric is sufficiently immersed in the resin solution, and thereafter the resin solution is squeezed away from the knitted fabric, to which the resin solution is attached, by use of a mangle roller where pressurization can be made between a pair of rollers, thereby adjusting the amount of the resin solution attached to the knitted fabric to a desired amount, to uniformly or substantially uniformly impregnate the knitted fabric with the resin solution. Next, the knitted fabric impregnated with the resin solution is immersed in a coagulation liquid mainly including a poor solvent to the resin, such as water, thereby coagulating and regenerating the resin (hereinafter, the resin to be wet-coagulated will be referred to as "wet resin".) An organic solvent such as a polar solvent other than the solvent in the resin solution may also be added to the coagulation liquid in order to adjust the regeneration rate of the resin. The temperature of the coagulation liquid is not particularly limited as long as it can allow the resin to be coagulated, and it may be, for example, 15 to 60° C.

In the present embodiment, it is preferable that the wet coagulation be performed and thereafter the following washing/drying step be conducted. First, the knitted fabric where the wet resin is coagulated and regenerated is washed in a washing liquid such as water, thereby removing the solvent remaining in the knitted fabric, such as DMF. After washing, the knitted fabric is pulled up from the washing liquid, and an excess of the washing liquid is squeezed away by use of a mangle roller or the like. Thereafter, the knitted fabric may be dried in a drier at 100° C. to 150° C. After the drying, the resulting resin-impregnated knitted fabric is preferably further subjected to processing such as slicing or buffing, thereby removing a skin layer on the surface layer to impart a predetermined thickness, from the viewpoint of an enhancement in uniformity of the next step, an immersion step.

[Immersion Step]

The immersion step is a step of immersing the resin-impregnated knitted fabric in an immersion liquid including a solvent in which the first resin is soluble, thereby partially re-dissolving the wet resin in the solvent. It is considered that the immersion step allows air bubbles (for example, a closed pore, and an open pore with a small opening) in the resin-impregnated knitted fabric to be decreased, thereby resulting in an enhancement in close contactability of the knitted fabric with the wet resin. The solvent for use in the immersion step is not particularly limited, and examples include N,N-dimethylformamide (DMF), N,N-dimethylacetamide (DMAC), methyl ethyl ketone (MEK) and dimethylsulfoxide (DMSO). The temperature condition in such immersion is preferably 15.0 to 25.0° C. from the viewpoint of decreasing air bubbles in the first resin and also preventing elution of the resin into the solvent, and the immersion time is preferably 5 to 30 seconds from the same viewpoint. Herein, a drying step is preferably provided after the above immersion step.

[Cutting Step]

The cutting step is a step of cutting the resin-impregnated knitted fabric after the immersion step, in the surface direction of the knitted fabric. The cutting step can form the cross section cut in the surface direction of the knitted fabric, as the polishing surface. FIG. 1 includes schematic views of the cutting step. FIG. 1 includes cross-sectional views of a resin-impregnated knitted fabric 1 after the immersion step, cut in the surface direction of the knitted fabric. As illustrated in FIG. 1, the knitted fabric is cut in the surface direction to make a polishing surface 2 (before secondary impregnation) in the present embodiment. In the polishing surface 2, each end of a fiber is uniformly distributed in the surface direction. In addition, each end 2' of a fiber in the polishing surface 2 is not required to be exposed, and the polishing surface may be covered with a resin in a subsequent secondary impregnation step or the like.

The cutting method is not particularly limited, and such cutting can be made by use of a band knife or the like.

[Secondary Impregnation Step]

The secondary impregnation step is a step of impregnating the resin-impregnated knitted fabric after the cutting step with a solution including a urethane prepolymer having an NCO equivalent of 450 or less and a curing agent. It is presumed that the secondary impregnation step allows a resin (hereinafter, this resin will be also referred to as "dry resin".) to be formed on the surface of the above wet resin.

In a specific example of the secondary impregnation step, first, a solution is prepared which includes a urethane prepolymer having an isocyanate group at an end, a curing agent, and a solvent in which these are soluble. The urethane prepolymer, the curing agent and the solvent that can be used here are the same as exemplified above.

Next, the resin-impregnated knitted fabric after the immersion step is immersed in the solution, and thereafter the solution is squeezed away from the resin-impregnated knitted fabric, to which the solution is attached, by use of a mangle roller where pressurization can be made between a pair of rollers, thereby adjusting the amount of the solution attached to the resin-impregnated knitted fabric to a desired amount, to uniformly or substantially uniformly impregnate the resin-impregnated knitted fabric with the solution. Next, the resin-impregnated knitted fabric impregnated with the solution is dried in a drier. Thus, the polishing pad of the present embodiment can be obtained in which the resin-impregnated knitted fabric is impregnated with the dry resin by polymerization with the urethane prepolymer and the curing agent. The drying temperature may be, for example, 100° C. to 140° C. Herein, the polishing surface of the polishing pad obtained in the secondary impregnation step may be further treated with a buff or the like.

The primary impregnation step, the immersion step and the secondary impregnation step described above are experienced to thereby provide the polishing pad of the present embodiment, having a desired configuration. The polishing pad, but is not intended to be limited to the following description, is presumed to have the following configuration.

That is, the primary impregnation step is experienced to thereby form the wet resin on the surface of the knitted fabric. In particular, wet coagulation is adopted in the primary impregnation step to thereby allow the wet resin to be attached uniformly in the knitted fabric. The resin-impregnated knitted fabric obtained at this stage, however, has many fine air bubbles in the resin due to a wet coagulation method, and cannot be said to have sufficient close contactability of the knitted fabric with the wet resin and sufficient strength. Next, the immersion step is experienced to thereby allow fine air bubbles in the wet resin to be filled with an immersion solution, and the wet resin is re-dissolved with warming by drying, thereby decreasing fine air bubbles (for example, a closed pore, and an open pore with a small opening) in the resin-impregnated knitted fabric and also increasing the density of the resin (wet resin) with which the knitted fabric is impregnated, around the fiber, resulting in an enhancement in close contactability of the fiber of the knitted fabric with the wet resin and also an enhancement in strength. In addition, fine air bubbles are decreased, thereby leading to uniformity of impregnation with the dry resin in the secondary impregnation step, and an enhancement in strength. Furthermore, the secondary impregnation step is experienced to thereby allow an additional dry resin layer to be formed on the surface of the wet resin layer on the knitted fabric fiber. The heat-setting step is experienced to thereby allow a fusing point, where a low melting fiber softened is fused at the intersection thereof, to be present.

According to the present embodiment, air bubbles are decreased in the immersion step, thereby resulting in securement of a space that can be impregnated in the secondary impregnation step and also an improvement in air permeability, to decrease a place into which the dry resin hardly penetrates, thereby increasing an area in which the dry resin is present. Therefore, uniform impregnation with the dry resin can be made. In addition, the wet resin on a portion not directly attached to the knitted fabric can be decreased, thereby suppressing peeling of the resin in the polishing pad during polishing, to result in an increase in lifetime. Thus, it is presumed that the knitted fabric in the polishing pad of the present embodiment acts as a base material and the wet resin layer is formed on the knitted fabric, thereby forming the dry resin layer on the wet resin layer. It is also presumed that both of close contactability of the knitted fabric and the wet resin layer and close contactability of the wet resin layer and the dry resin layer are favorable in the entire polishing pad. It is considered from the above viewpoint that the polishing pad of the present embodiment can ensure a sufficient strength.

The polishing pad obtained as described above may, if necessary, be then cut to a desired shape such as a circular shape and a desired dimension and may be subjected to examination such as confirmation of whether or not there are contamination, foreign substances, and the like.

The cutting step is experienced to thereby enable the resulting polishing pad to be at least partially covered with a resin (dry resin) on the cross section of the knitted fabric in the surface direction, to allow a cross section not covered with the resin and the surface of the resin with which the cross section is covered, to serve as the polishing surface. In such a polishing pad, each fiber end is uniformly distributed in the cross section obtained by cutting the knitted fabric constituted by warp knitting or weft knitting in the surface direction, therefore the fiber end distribution is directly reflected on a portion where the cross section directly serves as the polishing surface, and the fiber end distribution is indirectly reflected on a portion where the cross section is covered with the resin. As a result, not only the internal structure of the polishing pad described above is uniform, but also the distribution of protrusions and depressions of the polishing surface is uniform, and thus the polishing rate tends to be more enhanced. In addition, releasing of a fiber is suppressed on a portion where the cross section is covered with the resin. As a result, the polishing pad of the present embodiment can be more excellent in the polishing rate and can allow polishing surface quality to be ensured.

When the polishing pad of the present embodiment is used to polish a polishing workpiece (hereinafter, also referred to as "workpiece"), a double-faced tape (provided with an adhesion layer and a release sheet) for adhesion of the polishing pad to a polishing platen of a polishing machine may also be applied in advance onto a surface of the polishing pad, the surface being opposite to the polishing surface of the polishing pad.

In consideration of feeding of slurry and discharge of polishing sludge in polishing processing, the polishing surface of the polishing pad may be subjected to grooving and/or embossing. Examples of the planar shape (pattern) on the polishing surface of a groove include a radial shape, a lattice shape and a spiral shape. In addition, examples of the cross section shape of a groove include a rectangular shape, a U-shape, a V-shape and a semicircular shape. Furthermore, the pitch, the width and the depth of a groove are not particularly limited as long as discharge of polishing sludge and movement of slurry can be made.

[Method for Producing Polished Product]

A method for producing a polished product of the present embodiment is not particularly limited as long as it is a method for producing a polished product, including a polishing step of polishing a polishing workpiece by use of the polishing pad. The polishing step includes primary lapping (rough lapping), secondary lapping (finishing lapping), primary polishing (rough polishing), secondary polishing (finishing polishing), and any processing doubling as such a plurality of polishings.

The polishing workpiece is not particularly limited, and examples include a semiconductor device, a material for electronic components and the like, in particular, a Si substrate (silicon wafer), a SiC (silicon carbide) substrate, a GaAs (gallium arsenide) substrate and glass, and a thin substrate (polishing workpiece) such as a substrate for hard disc or LCD (liquid crystal display). In particular, the method for producing a polished product of the present embodiment can be suitably used as a production method of a material to be applied to a power device, LED, and the like, for example, a difficult-to-process material which has a difficulty in polishing processing, such as sapphire, SiC, GaN and diamond.

A conventionally known method can be used as the polishing method, and is not particularly limited. Hereinafter, the method including polishing processing the polishing workpiece by the polishing pad in the presence of an abrasive grain will be described as an example.

First, the polishing pad is mounted and secured to a polishing platen of a polishing machine. The polishing workpiece retained on a retaining platen which is disposed so as to be opposite to the polishing platen is then pressed on the polishing surface of the polishing pad and also the polishing platen and/or the retaining platen are/is rotated with a slurry being fed between the workpiece and the polishing pad, thereby applying polishing processing to a surface to be processed of the polishing workpiece.

The slurry may include a strong oxidant, a solvent and a polishing particle for use in chemical mechanical polishing.

The strong oxidant is not particularly limited, and examples thereof include potassium permanganate and sodium permanganate. Examples of the solvent include water and an organic solvent. The organic solvent is preferably hydrocarbon, more preferably a hydrocarbon having a high boiling point. The hydrocarbon is not particularly limited, and examples include paraffin-based hydrocarbon, olefin-based hydrocarbon, aromatic hydrocarbon and alicyclic hydrocarbon. Examples of the hydrocarbon having a high boiling point include a petroleum-based hydrocarbon having an initial boiling point of 220° C. or more. Such solvents may be used singly or in combinations of two or more thereof.

The slurry may also include, if necessary, other additive. Examples of such other additive include a nonionic surfactant, an anionic surfactant, carboxylate, carboxylic acid amide and carboxylic acid.

The polishing workpiece is not particularly limited as long as it is conventional one to be subjected to the polishing processing, and examples include a semiconductor wafer, a magnetic disc and optical glass. Among them, a semiconductor wafer is preferable, and a SiC substrate, a sapphire substrate or a GaN substrate is preferable from the viewpoint that the function effect of the polishing pad of the present embodiment can be more effectively utilized. The material therefor is preferably a difficult-to-cut material such as a SiC single crystal and a GaN single crystal, and it may be a single crystal of sapphire, silicon nitride, aluminum nitride or the like.

EXAMPLES

Hereinafter, the present invention will be more specifically described with reference to Examples and Comparative Examples. The present invention is not intended to be limited to the following Examples.

[A Hardness]

A pressing needle (gauge head) was pressed on the surface of a test piece having a thickness of 4.5 mm or more, through a spring, and the A hardness of the polishing pad was measured from the pressing depth of the pressing needle after 30 seconds. A durometer type A was used as the measurement apparatus. Such measurement was performed three times to provide the arithmetic average, thereby determine the A hardness. Specifically, the polishing pad was cut out to a size of 10 cm×10 cm, thereby providing a sample piece, and a plurality of such sample pieces were stacked so that the thickness was 4.5 m or more.

[Compressive Modulus and Compressive Elastic Modulus]

A Schopper type thickness gauge (pressurizing surface: a circle having a diameter of 1 cm) was used to measure the compressive modulus and the compressive elastic modulus of the polishing pad according to Japanese Industrial Standards (JIS L 1021). Specifically, the thickness to after pressurization with the initial load for 30 seconds was measured, and the thickness $t_1$ after standing under the final load for 5 minutes was then measured. After removal of all the loads and standing for 1 minute, the thickness $t_0'$ after pressurization with the initial load for 30 seconds was measured. Herein, the initial load was 100 g/cm$^2$ and the final load was 1120 g/cm$^2$. The compressive modulus was calculated according to the following expression (1), and the compressive elastic modulus was calculated according to the following expression (2).

$$\text{compressive modulus (\%)}=(t_0-t_1)/t_0\times 100 \quad \text{Expression (1):}$$

$$\text{compressive elastic modulus (\%)}=(t_0'-t_1)/(t_0-t_1)\times 100 \quad \text{Expression (2):}$$

[Thickness]

A Schopper type thickness gauge (pressurizing surface: a circle having a diameter of 1 cm) was used to measure the thickness of the polishing pad according to Japanese Industrial Standards (JIS K 6505). Specifically, three sample pieces each obtained by cutting out the polishing pad to a size of 10 cm×10 cm were prepared, each of the sample pieces was set at a predetermined position of the thickness gauge, thereafter a pressurizing surface where a load of 480 g/cm$^2$ was applied was placed on the surface of each of the sample pieces, and the thickness was measured after a lapse of 5 seconds. The thickness was measured at five positions with respect to each of the sample pieces, to calculate the arithmetic average, and furthermore the arithmetic average of the three sample pieces was determined.

[Density]

The polishing pad was cut out to a size of 10 cm×10 cm to provide a sample piece, the mass of the sample piece was measured, and the density (bulk density) (g/cm$^3$) of the polishing pad was calculated from the volume determined from the size, and the mass.

[Polishing Test 1]

The polishing pad was attached to a platen of a polishing machine (manufactured by SpeedFam Company Limited, 32-inch), and the polishing surface of the polishing pad was subjected to dressing (pressurization: 1.3 kPa, time: 10 min) with water being fed at 900 mL/min. A "diamond dresser (#100)" manufactured by Asahi Diamond Industrial Co., Ltd. was here used as a diamond dresser. Next, a SiC wafer (3-inch in diameter×420 μm in thickness) as a polishing workpiece was polished by use of the polishing pad in polishing conditions shown below.

(Polishing Conditions)

Slurry: produced by Sinmat Inc., product name: SC1AJ.

Slurry flow rate: 5 mL/min

Number of rotations: 35 rpm

Polishing time: 120 min/BT

Polishing pressure: 450 gf/cm$^2$

[Polishing Test 2]

Polishing was performed in the same manner as in polishing test 1 except that the polishing workpiece was changed to a sapphire wafer (2-inch in diameter×375 μm in thickness) and polishing conditions shown below were adopted.

(Polishing Conditions)

Slurry: produced by Fujimi Incorporated, a mixture of product name "Compol 80" and water at a ratio of 2:1 was used.

Slurry flow rate: 3 L/min (circulation)

Number of rotations: 70 rpm

Polishing time: 180 min/BT

Polishing pressure: 400 gf/cm$^2$ (Polishing Rate)

The polishing rate (unit: μm/hr) was evaluated by using the amount of polishing determined from decrease in the mass of the polishing workpiece before and after processing in polishing tests 1 and 2 above, as well as the polishing area and the specific gravity of the polishing workpiece, to calculate the thickness removed by polishing, to thereby determine the thickness removed per hour. Herein, six of the polishing workpieces were polished to determine the average value as the polishing rate in polishing test 1, and sixty four of the polishing workpieces were polished to determine the average value as the polishing rate in polishing test 2.

(Surface Quality)

Five of the polishing workpieces after polishing test 1 or 2 were visually confirmed with respect to scratches on the surface polished. As described below, a case where defects such as scratches were observed in large numbers was rated as "2", a case where defects such as scratches were not almost observed was rated as "1" and a case where no defects such as scratches were observed was rated as "0", and the weighted average of five of the polishing workpieces was determined. Herein, the surface of each of the polishing workpieces after the polishing tests was a mirror surface. Whether or not "no defects such as scratches were observed" was achieved was determined according to whether or not scratches and the like were observed on the surface of each of the polishing workpieces, being more or less a mirror surface.

0: no defects such as scratches were observed

1: defects such as scratches were not almost observed

2: defects such as scratches were observed in large numbers

[Knitted Fabric and Non-Woven Fabric]

Knitted fabrics A to B and non-woven fabric A, each formed from a polyethylene terephthalate fiber, were prepared. The configuration of each knitted fabric is described in Table 1 below. Herein, a fiber constituting the front and rear surfaces of each knitted fabric and a fiber constituting the intermediate structure (located between the front surface and the rear surface) of each knitted fabric are separately described with respect to warp knitting and circular knitting.

TABLE 1

| | | Configuration of fiber | | | | |
|---|---|---|---|---|---|---|
| | Knitting | Position of fiber | Fineness of fiber/number of filaments | Gray yarn/false twisted yarn | Fineness of single yarn | Thickness of knitted fabric |
| Knitted fabric A | Warp knitting; double raschel | Front and rear surfaces | E56T:24F | Gray yarn | 2.33 dtex | about 3 mm |
| | | Intermediate structure | E84T/36F | False twisted yarn | 2.33 dtex | |
| Knitted fabric B | Circular knitting, cardboard knitting | Front and rear surfaces | E167T/748F | False twisted yarn | 3.48 dtex | about 2.2 mm |
| | | Intermediate structure | E1677T/48F, E84T/36F | False twisted yarn | 2.33 dtex | |
| Non-woven fabric A | Non-woven fabric (needle punch) | — | — | — | 3.33 dtex | 2.4 mm |

Herein, knitted fabric A was a warp knitted fabric (double raschel) knitted by a double raschel machine having L1 to L6 of yarn feeders and configured by the following knitted fabric texture, and a false twisted yarn was fed through L3 and L4 and gray yarn was fed through L1, L2, L5 and L6.

L1: 4-4-4-4/0-0-0-0//

L2: 0-1-1-1/1-0-0-0//

L3: 0-1-1-2/1-0-2-1//

L4: 1-2-0-1/2-1-1-0//

L5: 0-0-0-1/1-1-1-0//

L6: 0-0-4-4/4-4-0-0//

Knitted fabric B was a circle knitted fabric (cardboard knitted fabric) knitted by a circular knitting machine having F1 to F6 of yarn feeders and configured by the following knitted fabric texture.

F1: tuck (tuck texture made by an odd-numbered cylinder needle and an even-numbered dial needle (one knitting overlapped with the next knitting))

F2: half dial (not knitting with any cylinder, but knitting with only an odd-numbered dial needle)

F3: half cylinder (not knitting with any dial, but knitting with only an even-numbered cylinder needle)

F4: tuck knitting (opposite of F1, tuck texture made by an even-numbered cylinder needle and an odd-numbered dial needle)

F5: half dial (opposite of F2, not knitting with any cylinder, but knitting with only an even-numbered dial needle)

F6: half cylinder (opposite of F3, not knitting with any dial, but knitting with only an even-numbered cylinder needle)

Example 1

(Primary Impregnation Step)

Mixed were 56.7 parts by mass of a polycarbonate-based urethane resin (produced by DIC Corporation, trade name "Crisvon S705") and 43.3 parts by mass of N,N-dimethylformamide, thereby preparing a resin solution. Knitted fabric A was immersed in the resulting resin solution, and an excess of the resin solution was squeezed away by use of a mangle roller, thereby substantially uniformly impregnating knitted fabric A with the resin solution. Next, knitted fabric A was immersed in a coagulation liquid including water at 18° C., thereby coagulating and regenerating a resin for primary impregnation, to provide a resin-impregnated knitted fabric. Thereafter, the resin-impregnated knitted fabric was taken out from the coagulation liquid and dried, and subjected to buffing, to thereby provide a resin-impregnated knitted fabric from which a surface skin layer was removed.

(Immersion Step)

Next, the resin-impregnated knitted fabric obtained above was immersed in an immersion solvent where N,N-dimethylformamide and pure water were mixed in a ratio of 65:35. Thereafter, drying was performed to provide a resin-impregnated knitted fabric after the immersion step.

(Cutting Step)

Thereafter, the resin-impregnated knitted fabric was dried and sliced by use of a band knife type of slicer in the surface direction so that the thickness was even up and down.

(Secondary Impregnation Step)

Furthermore, 24.11 parts by mass of a urethane prepolymer (produced by DIC Corporation, trade name "Pandex TM363", NCO equivalent: 286), 10.91 parts by mass of a curing agent (produced by DIC Corporation, trade name "Pandex E") and 60.04 parts by mass of N,N-dimethylformamide were mixed to prepare a resin solution. The resin-impregnated knitted fabric after the cutting step was immersed in the resulting resin solution, and thereafter nip conditions of the mangle roller were adjusted so that the density of the polishing pad was 0.36 g/cm$^3$, thereby squeezing away the resin solution. Thereafter, washing/drying was performed to provide a polishing pad of Example 1. The content of the knitted fabric in the entire polishing pad was 37% by mass. Herein, the NCO equivalent was measured according to JIS K 7301 (1995) (The same shall apply hereunder).

Example 2

A polishing pad of Example 2 was obtained by the same method as in Example 1 except that nip conditions of the mangle roller were adjusted so that the density of the polishing pad was 0.41 g/cm$^3$. The content of the knitted fabric in the entire polishing pad was 32% by mass.

Comparative Example 1

A polishing pad of Comparative Example 1 was obtained by the same method as in Example 1 except that non-woven fabric A was used instead of knitted fabric A and nip conditions of the mangle roller were adjusted so that the density of the polishing pad was 0.37 g/cm. The content of the non-woven fabric in the entire polishing pad was 34% by mass.

Example 3

A polishing pad of Example 3 was obtained by the same method as in Example 2 except that a groove having a pitch of 30 mm, a width of 2 mm and a depth of 0.5 mm and having a U-shaped cross section was provided on the polishing surface. The content of the knitted fabric in the entire polishing pad was 32% by mass.

Example 4

A polishing pad of Example 4 was obtained by the same method as in Example 1 except that knitted fabric B was used instead of knitted fabric A, nip conditions of the mangle roller were adjusted so that the density of the polishing pad was 0.56 g/cm, and a groove having a pitch of 30 mm, a width of 2 mm and a depth of 0.4 mm and having a U-shaped cross section was provided on the polishing surface. The content of the knitted fabric in the entire polishing pad was 53% by mass.

Comparative Example 2

A polishing pad of Comparative Example 2 was obtained by the same method as in Example 1 except that nip conditions of the mangle roller were adjusted so that the density of the polishing pad was 0.42 g/cm. The content of the non-woven fabric in the entire polishing pad was 30% by mass.

Table 2 shows the hardness, the compressive modulus, the compressive elastic modulus, the thickness, and the density of the polishing pad obtained in each of Examples 1 to 4 and Comparative Examples 1 to 2. In addition, the evaluation results of the polishing rate and the surface quality in the conditions of polishing tests 1 to 2 above are also shown.

TABLE 2

| | A Hardness | Compressive modulus (%) | Compressive elastic modulus (%) | Thickness (mm) | Density (g/cm$^3$) | Polishing test | Polishing rate | Surface quality |
|---|---|---|---|---|---|---|---|---|
| Example 1 | 70.0 | 6.8 | 58.8 | 1.25 | 0.36 | 1 | 0.812 μm/h | 1.0 |
| Example 2 | 74.5 | 6.0 | 66.6 | 1.21 | 0.41 | 1 | 0.974 μm/h | 1.0 |
| Comparative Example 1 | 75.0 | 6.1 | 57.0 | 1.32 | 0.37 | 1 | 0.638 μm/h | 2.0 |
| Example 3 | 74.5 | 6.0 | 66.6 | 1.21 | 0.41 | 2 | 3.000 μm/h | 1.0 |
| Example 4 | 85.5 | 4.1 | 70.4 | 0.98 | 0.56 | 2 | 4.125 μm/h | 1.0 |
| Comparative Example 2 | 79.0 | 4.2 | 59.7 | 1.30 | 0.42 | 2 | 2.282 μm/h | 2.0 |

[Knitted fabric]

There were prepared double raschel warp knitted fabric A1 where a paralleled knitting yarn with a low melting nylon fiber being paralleled to a polyethylene terephthalate fiber was used as the knitting yarn constituting the front and rear surfaces and a polyethylene terephthalate fiber was used as the knitting yarn constituting the intermediate structure; double raschel warp knitted fabric A2 which was the same as knitted fabric A1 except that no low melting nylon fiber was paralleled; circular knitted cardboard knitted fabric B1 where a paralleled knitting yarn with a low melting nylon fiber being paralleled to a polyethylene terephthalate fiber was used as the knitting yarn constituting the front and rear surfaces and a polyethylene terephthalate fiber was used as the knitting yarn constituting the intermediate structure; and circular knitted cardboard knitted fabric B2 which was the same as knitted fabric B1 except that no low melting nylon fiber was paralleled. Table 1 below describes configuration of each knitted fabric. Herein, the fiber constituting the front and rear surfaces of the knitted fabric and the fiber constituting the intermediate structure (between the front surface and the rear surface) of the knitted fabric are separately described.

TABLE 3

| | | | Configuration of fiber | | | | | | | |
|---|---|---|---|---|---|---|---|---|---|---|
| | | | Polyethylene terephthalate (softening point 240° C., melting point 255-260° C.) | | | Low melting nylon (softening point 40° C., melting point 120° C.) | | | | |
| | Knitting | Location of fiber | Fineness of fiber/number of filaments | Gray yarn/false twisted yarn | Fineness of single yarn | Fineness of fiber/number of filaments | Gray yarn/false twisted yarn | Fineness of single yarn | Yarn feeder for insertion of paralleled yarn | Thickness of knitted fabric |
| Knitted fabric A1 | Warp knitting, double raschel | Front and rear surfaces | E56T/24F | Gray yarn | 2.33 dtex | 7T/3F | Gray yarn | 2.33 dtex | L1, L2, L5, L6 | About 3 mm |
| | | Intermediate structure | E84T/36F | False twisted yarn | 2.33 dtex | None | | — | — | |
| Knitted fabric A2 | Warp knitting, double raschel | Front and rear surfaces | E56T/24F | Gray yarn | 2.33 dtex | None | | — | — | About 3 mm |
| | | Intermediate structure | E84T/36F | False twisted yarn | 2.33 dtex | None | | — | — | |
| Knitted fabric B1 | Circular knitting, cardboard knitting | Front and rear surfaces | E167T/48F | False twisted yarn | 3.48 dtex | 14T/16F | Gray yarn | 2.33 dtex | F2, F3, F5, F6 | About 2.2 mm |
| | | Intermediate structure | E167T/48F, E84T/36F | False twisted yarn | 2.33 dtex | None | | — | — | |
| Knitted fabric B2 | Circular knitting, cardboard knitting | Front and rear surfaces | E167T/48F | False twisted yarn | 3.48 dtex | None | | — | — | About 2.2 mm |
| | | Intermediate structure | E167T/48F, E84T/36F | False twisted yarn | 2.33 dtex | None | | — | — | |

Herein, knitted fabrics A1 and A2 were each a warp knitted fabric (double raschel) knitted by a double raschel machine having L1 to L6 of yarn feeders and configured by the following knitted fabric texture, and a false twisted yarn was fed through L3 and L4 and gray yarn was fed through L1, L2, L5 and L6. With respect to knitted fabric A1, the yarn feeder of the low melting nylon fiber as the paralleled yarn was as shown in Table 1.

L1: 4-4-4-4/0-0-0-0//

L2: 0-1-1-1/1-0-0-0//

L3: 0-1-1-2/1-0-2-1//

L4: 1-2-0-1/2-1-1-0//

L5: 0-0-0-1/1-1-1-0//

L6: 0-0-4-4/4-4-0-0//

Knitted fabrics B1 and B2 were each a circle knitted fabric (cardboard knitted fabric) knitted by a circular knitting machine having F1 to F6 of yarn feeders and configured by the following knitted fabric texture. With respect to knitted fabric B1, the yarn feeder of the low melting nylon fiber as the paralleled yarn was as shown in Table 1.

F1: tuck (tuck texture made by an odd-numbered cylinder needle and an even-numbered dial needle (one knitting overlapped with the next knitting))

F2: half dial (not knitting with any cylinder, but knitting with only an odd-numbered dial needle)

F3: half cylinder (not knitting with any dial, but knitting with only an even-numbered cylinder needle)

F4: tuck knitting (opposite of F1, tuck texture made by an even-numbered cylinder needle and an odd-numbered dial needle)

F5: half dial (opposite of F2, not knitting with any cylinder, but knitting with only an even-numbered dial needle)

F6: half cylinder (opposite of F3, not knitting with any dial, but knitting with only an even-numbered cylinder needle)

Knitted fabric A1, knitted fabric A2, knitted fabric B1, and knitted fabric B2 knitted as described above were subjected to heat-setting by use of a hot air drier in conditions of 100° C. and 10 minutes. Thus, knitted fabric A1 and knitted fabric B1 each having a paralleled knitting yarn with a low melting nylon fiber being paralleled was in the state where the low melting nylon fiber was mutually fused at the intersection thereof. Hereinafter, each knitted fabric after heat-setting was used in Examples and Comparative Examples.

Example 5

(Primary Impregnation Step)

Mixed were 56.7 parts by mass of a polycarbonate-based urethane resin (produced by DIC Corporation, trade name "Crisvon S705") and 43.3 parts by mass of N,N-dimethylformamide, thereby preparing a resin solution. Knitted fabric A1 was immersed in the resulting resin solution, and an excess of the resin solution was squeezed away by use of a mangle roller, thereby substantially uniformly impregnating knitted fabric A1 with the resin solution. Next, knitted fabric A1 was immersed in a coagulation liquid including water at 18° C., thereby coagulating and regenerating a resin for primary impregnation, to provide a resin-impregnated knitted fabric. Thereafter, the resin-impregnated knitted fabric was taken out from the coagulation liquid and dried, and subjected to buffing, to provide a resin-impregnated knitted fabric from which a surface skin layer was removed.

(Immersion Step)

Next, the resin-impregnated knitted fabric obtained above was immersed in an immersion solvent where N,N-dimethylformamide and pure water were mixed in a ratio of 65:35. Thereafter, drying was performed to provide a resin-impregnated knitted fabric after the immersion step.

(Cutting Step)

Thereafter, the resin-impregnated knitted fabric was dried and sliced by use of a band knife type of slicer in the surface direction so that the thickness was even up and down.

(Secondary Impregnation Step)

Furthermore, 24.11 parts by mass of a urethane prepolymer (produced by DIC Corporation, trade name "Pandex TM363", NCO equivalent: 286), 10.91 parts by mass of a curing agent (produced by DIC Corporation, trade name "Pandex E") and 60.04 parts by mass of N,N-dimethylformamide were mixed to prepare a resin solution. The resin-impregnated knitted fabric after the cutting step was immersed in the resulting resin solution, and thereafter nip conditions of the mangle roller were adjusted so that the density of the polishing pad was 0.36 g/cm$^3$, thereby squeezing away the resin solution. Thereafter, washing/drying was performed to provide a polishing pad of Example 5. The amount of the resin attached to 100% by mass of the knitted fabric was 198% by mass. Herein, the NCO equivalent was measured according to JIS K 7301 (1995) (The same shall apply hereunder).

Comparative Example 3

A polishing pad of Comparative Example 3 was obtained by the same method as in Example 5 except that knitted fabric A2 was used instead of knitted fabric A1. The amount of the resin attached to 100% by mass of the knitted fabric was 198% by mass.

Example 6

A polishing pad of Example 6 was obtained by the same method as in Example 5 except that knitted fabric B1 was used instead of knitted fabric A1. The amount of the resin attached to 100% by mass of the knitted fabric was 89% by mass.

Comparative Example 4

A polishing pad of Comparative Example 4 was obtained by the same method as in Example 6 except that knitted fabric B2 was used instead of knitted fabric B1. The amount of the resin attached to 100% by mass of the knitted fabric was 89% by mass.

Table 3 shows the hardness, the compressive modulus, the compressive elastic modulus, the thickness, and the density of the polishing pad obtained in each of Example 5 to 6 and Comparative Examples 3 to 4. In addition, the evaluation results of the polishing rate and the surface quality in the conditions of polishing tests 1 to 2 above are also shown.

TABLE 4

| | Name of knitted fabric | A Hardness | Compressive modulus (%) | Compressive elastic modulus (%) | Thickness (mm) | Density (g/cm$^3$) | Polishing test | Polishing rate | Surface quality |
|---|---|---|---|---|---|---|---|---|---|
| Example 5 | A1 | 70.0 | 6.8 | 58.9 | 1.25 | 0.37 | 1 | 0.891 μm/h | 0.8 |
| Comparative Example 3 | A2 | 70.0 | 6.8 | 58.8 | 1.25 | 0.36 | 1 | 0.812 μm/h | 1.0 |
| Example 6 | B1 | 85.5 | 4.2 | 70.6 | 0.98 | 0.58 | 2 | 4.561 μm/h | 0.6 |
| Comparative Example 4 | B2 | 85.5 | 4.1 | 70.4 | 0.98 | 0.56 | 2 | 4.125 μm/h | 1.0 |

INDUSTRIAL APPLICABILITY

The present invention has industrial applicability to a polishing pad, in particular, a polishing pad for a difficult-to-cut material.

REFERENCE SIGNS LIST

1 . . . resin-impregnated knitted fabric, 2 . . . polishing surface, 2' . . . end

The invention claimed is:

1. A polishing pad comprising: a knitted fabric constituted by warp knitting or weft knitting; and a resin with which the knitted fabric is impregnated, wherein the polishing pad has a cross section, cut in a surface direction of the knitted fabric, as a polishing surface, and wherein a fiber constituting an intermediate structure of the knitted fabric is a false twisted yarn, and comprises a paralleled knitting yarn constituted with two or more fibers having a different melting point from each other being paralleled, wherein a fineness of the fiber with the lower melting point is 5 to 17.5% relative to the fineness of the fiber with the higher melting point; and the resin comprises a first resin and a second resin, different from the first resin, wherein the second resin is a reaction product of a urethane prepolymer having an NCO equivalent of 250 to 320 and a curing agent.

2. The polishing pad according to claim 1, wherein the resin comprises a first resin and a second resin different from the first resin, and a content of the knitted fabric is 30 to 60% by mass based on a total amount of the knitted fabric, the first resin and the second resin.

3. The polishing pad according to claim 1, wherein a number average diameter of a single yarn constituting the knitted fabric is 3 to 30 μm.

4. The polishing pad according to claim 1, wherein a fineness of the single yarn constituting the knitted fabric is 0.1 to 10 dtex.

5. The polishing pad according to claim 1, having a compressive modulus of 0.5 to 20%.

6. The polishing pad according to claim 1, having a compressive elastic modulus of 50 to 98%.

7. The polishing pad according to claim 1, having an A hardness of 50 to 98°.

8. The polishing pad according to claim 1, having a thickness of 0.5 to 5.0 mm.

9. The polishing pad according to claim 1, wherein a knitting yarn constituting front and rear surfaces of the knitted fabric comprises the paralleled knitting yarn.

10. The polishing pad according to claim 1, wherein a melting point of a fiber having the lowest melting point among the two or more fibers having a different melting point from each other is 50 to 180° C.

11. The polishing pad according to claim 1, wherein a melting point of a fiber having the highest melting point among the two or more fibers having a different melting point from each other is 200 to 400° C.

12. A method for producing a polishing pad, comprising:

a primary impregnation step of impregnating a knitted fabric constituted by warp knitting or weft knitting with a first resin solution comprising a first resin, and performing wet coagulation to thereby provide a resin-impregnated knitted fabric, wherein a fiber constituting an intermediate structure of the knitted fabric is a false twisted yarn, and comprises a paralleled knitting yarn constituted with two or more fibers having a different melting point from each other being paralleled, wherein a fineness of the fiber with the lower melting point is 5 to 17.5% relative to the fineness of the fiber with the higher melting point, an immersion step of immersing the resin-impregnated knitted fabric in an immersion liquid comprising a solvent in which the first resin is soluble, a cutting step of cutting the resin-impregnated knitted fabric after the immersion step, in a surface direction of the knitted fabric, to provide a cross-section of the resin-impregnated knitted fabric as a polishing surface, and a secondary impregnation step of impregnating the resin-impregnated knitted fabric after the cutting step with a second resin solution comprising a urethane prepolymer having an NCO equivalent of 250 to 320 and a curing agent.

13. The method for producing a polishing pad according to claim 12, wherein the knitted fabric is a knitted fabric knitted by warp knitting or weft knitting, comprising a paralleled knitting yarn constituted with two or more fibers having a different melting point from each other being paralleled, and the method further comprises a heat-setting step of performing heating at a temperature equal to or more than a softening point and less than a melting point of a fiber having the lowest melting point among the two or more fibers having a different melting point from each other, before the primary impregnation step.

14. The method for producing a polishing pad according to claim 12, wherein the first resin is soluble in one or more selected from the group consisting of N,N-dimethylformaldehyde, dimethylacetamide, methyl ethyl ketone and dimethylsulfoxide.

15. The method for producing a polishing pad according to claim 12, wherein the solvent comprises one or more solvents selected from the group consisting of N,N-dimethylformaldehyde, dimethylacetamide, methyl ethyl ketone and dimethylsulfoxide.

16. A method for producing a polished product, comprising:

a polishing step of polishing a polishing workpiece by use of the polishing pad according to claim 1.

* * * * *